US009253837B1

(12) United States Patent
Hong

(10) Patent No.: US 9,253,837 B1
(45) Date of Patent: Feb. 2, 2016

(54) APPARATUS FOR DRIVING LIGHT EMITTING DIODE (LED) AND ILLUMINATION SYSTEM INCLUDING THE SAME

(71) Applicant: Seung Hun Hong, Namyangju-si (KR)

(72) Inventor: Seung Hun Hong, Namyangju-si (KR)

(73) Assignee: Dongbu HiTek Co., Ltd., Bucheon-si (KR)

( * ) Notice: Subject to any disclaimer, the term of this patent is extended or adjusted under 35 U.S.C. 154(b) by 0 days.

(21) Appl. No.: 14/707,411

(22) Filed: May 8, 2015

(30) Foreign Application Priority Data

Sep. 11, 2014 (KR) ..... 10-2014-0120223

(51) Int. Cl.
*H05B 33/08* (2006.01)

(52) U.S. Cl.
CPC ..... *H05B 33/0827* (2013.01); *H05B 33/0809* (2013.01)

(58) Field of Classification Search
CPC ..... H05B 33/083; H05B 33/0809; H05B 33/0827
USPC ..... 315/186, 291, 294
See application file for complete search history.

(56) References Cited

U.S. PATENT DOCUMENTS

2014/0210351 A1* 7/2014 Yu ..... H05B 33/083 315/122
2014/0265885 A1* 9/2014 Hu ..... H05B 33/083 315/186
2014/0265894 A1* 9/2014 Weaver ..... H05B 33/083 315/193
2015/0257225 A1* 9/2015 Yu ..... H05B 33/0809 315/122

* cited by examiner

*Primary Examiner* — Don Le
(74) *Attorney, Agent, or Firm* — Andrew D. Fortney; Central California IP Group, P.C.

(57) ABSTRACT

An LED driving apparatus controls a light emitting unit including first to k-th LED arrays, a rectifier for rectifying an AC signal, and first to (k−1)-th driving units respectively corresponding to the first to (k−1)-th LED arrays. Each driving unit includes an input terminal connected to a first terminal of the LED array, a sensing terminal connected to a second terminal of the LED array, an output terminal connected to a next driving unit, a transistor between the input terminal and the sensing terminal, and a sensing resistor between the sensing terminal and the output terminal. The rectified signal or voltage is applied to the first driving unit.

20 Claims, 12 Drawing Sheets

APPARATUS FOR DRIVING LIGHT EMITTING DIODE (LED) AND ILLUMINATION SYSTEM INCLUDING THE SAME

This application claims the benefit of Korean Patent Application No. 10-2014-0120223, filed on Sep. 11, 2014, which is hereby incorporated by reference as if fully set forth herein.

BACKGROUND OF THE INVENTION

1. Field of the Invention

Embodiments relate to an apparatus for driving a light emitting diode (LED) and an LED system including the same.

2. Discussion of the Related Art

With the development of semiconductor technology, the efficiency of light emitting diodes (LEDs) has been significantly improved. An LED has advantages such as long lifetime, low energy consumption, economic efficiency and eco-friendliness, as compared to existing illumination apparatuses such as incandescent lamps and fluorescent lamps. Given these advantages, the LED is currently attracting considerable attention as a light source for replacing the backlight of a flat panel display apparatus such as liquid crystal displays (LCDs) and traffic lights.

In general, if an LED array is used as a light source and an alternating current (AC) power source is used as a power source, there is a need for an LED control apparatus for controlling on/off states of the LED array.

The LED control apparatus for controlling the LED array may generally rectify the AC voltage and control on/off states of the LED array using the rectified pulsating current voltage.

SUMMARY OF THE INVENTION

Accordingly, embodiments are directed to an apparatus for driving a light emitting diode (LED), array of LEDs, or unit including a plurality of LED arrays and an LED system including the same that substantially obviate one or more problems due to limitations and disadvantages of the related art.

One object of embodiments of the present invention is to provide an apparatus for driving an LED, array of LEDs, or unit including a plurality of LED arrays and an LED system including the same, which are capable of suppressing total harmonic distortion (THD) and electromagnetic interference (EMI).

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose(s) of the embodiments, as embodied and broadly described herein, an apparatus for driving and/or controlling a light emitting unit including first to k-th arrays of a light emitting diodes (LEDs) includes a rectifier configured to rectify an alternating current (AC) signal and supply a rectified signal or voltage to the light emitting unit, and first to (k−1)-th driving units respectively corresponding to the first to (k−1)-th LED arrays. Each of the first to (k−1)-th driving units includes an input terminal connected to a first (e.g., input or positive) terminal of the corresponding LED array, a sensing terminal connected to a second (e.g., output or negative) terminal of the corresponding LED array, an output terminal connected to an input terminal of a next driving unit, a transistor between the input terminal and the sensing terminal, and a sensing resistor between the sensing terminal and the output terminal. The rectified signal may be applied to the input terminal of the first driving unit, and the output terminal of the (k−1)-th driving unit may be connected to a first (e.g., input or positive) terminal of the k-th LED array.

The transistor may be turned on or off based on a voltage at the sensing terminal.

The apparatus may further include an amplifier including a first input terminal connected to the sensing terminal, a second input terminal configured to receive a reference voltage, and an output terminal connected to a gate of the transistor.

When a voltage across the LED array is equal to or greater than an operating voltage of the LED array, the corresponding transistor (i.e., for that LED array) may be turned off.

When a voltage across the LED array is less than an operating voltage of the LED array, the corresponding transistor (i.e., for that LED array) may be turned on.

In another aspect, the apparatus for driving and/or controlling a light emitting unit including first to k-th LED arrays includes a rectifier configured to rectify an alternating current (AC) signal and supply a rectified signal or voltage to the light emitting unit, and a plurality of driving units respectively corresponding to the LED arrays except for the k-th LED array and connected in series. Each of the plurality of driving units includes an input terminal and a sensing terminal connected to a unique one of the LED arrays other than the k-th LED array, and an output terminal connected to an input terminal of a next driving unit. The rectified signal or voltage is applied to the input terminal of the first one of the driving units, and the output terminal of the last one of the driving units is connected to a first (e.g., input or positive) terminal of the k-th LED array. Each of the plurality of driving units forms a first current path between the input terminal and the output terminal, or a second current path comprising the LED array and at least one of the sensing terminal and the output terminal, according to a voltage across the LED array and/or a reference voltage.

Each of the driving units may further include a transistor including a gate, a first source/drain terminal connected to the input terminal and a second source/drain terminal connected to the sensing terminal.

Each of the driving units may further include a sensing resistor connected between the sensing terminal and the output terminal.

Each of the driving units may include an amplifier including a first input terminal connected to a node between the sensing resistor and the sensing terminal, a second input terminal configured to receive a reference voltage, and an output terminal connected to the gate of the transistor.

In another aspect, a lighting system includes a light emitting unit including first to k-th arrays of light emitting diodes (LEDs), and the present apparatus for driving and/or controlling the light emitting unit.

According to embodiments of the invention, it is possible to suppress harmonic distortion (e.g., total harmonic distortion, or THD) and electromagnetic interference (EMI) and to improve a degree of freedom of the operating voltage of a light emitting diode array.

It is to be understood that both the foregoing general description and the following detailed description of embodiments are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle(s) of the invention. In the drawings.

DETAILED DESCRIPTION OF THE INVENTION

Figure 1:
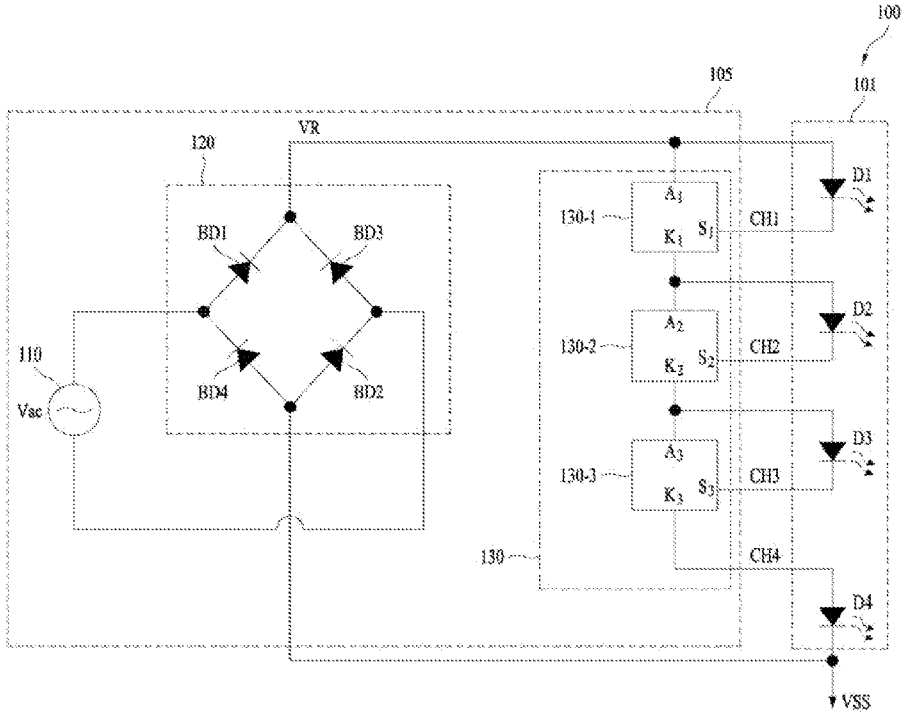
FIG. 1 is a block diagram showing an illumination apparatus according to one or more embodiments.

Hereinafter, embodiments of the invention will be clearly appreciated through the accompanying drawings and the following description thereof. In the description of various embodiments, it will be understood that, when an element such as a layer (film), region, pattern or structure is referred to as being "on" or "under" another element, such as a substrate, layer (film), region, pad or pattern, it can be directly "on" or "under" the other element, or one or more intervening elements may be therebetween. It will also be understood that "on" or "under" the element is described relative to the drawings.

In the drawings, the size of each layer may be exaggerated, omitted or schematically illustrated for clarity and convenience. In addition, the size of each constituent element does not necessarily reflect the actual size thereof. In addition, the same reference numerals designate the same constituent elements throughout the description of the drawings.

FIG. 1 is a block diagram showing an illumination apparatus 100 according to one or more embodiments on the invention.

Referring to FIG. 1, the exemplary illumination apparatus 100 includes an exemplary light emitting unit 101 and an exemplary light emitting diode (LED) driving unit for controlling operation (e.g., on/off states) of the light emitting unit 101.

The light emitting unit 101 includes a plurality of LED arrays (e.g., D1 to D4).

For example, although the light emitting unit 101 includes four LED arrays D1 to D4 in FIG. 1, the number of LED arrays is not limited thereto.

Each of the LED arrays D1 to D4 may include one or more LEDs. If a plurality of LEDs is included in each of the LED arrays D1 to D4, the plurality of LEDs may be connected in series, in parallel or both in series and in parallel.

The LED driving unit 105 controls on and off states of each of the exemplary LED arrays D1 to D4 using an AC voltage $V_{ac}$.

The LED driving unit 105 may include an AC power supply 110, a rectifier 120, a controller 130 and channel lines CH1 to CH4.

The AC power supply 110 provides an AC signal $V_{ac}$ to the rectifier 120.

Figure 11:
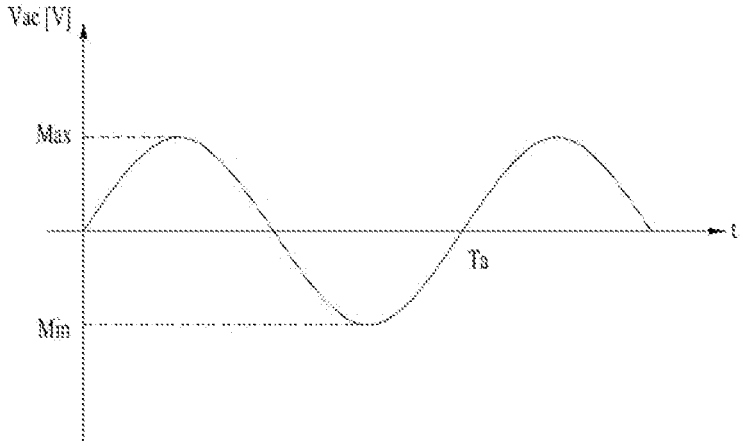
FIG. 11 is a diagram showing the waveform of an AC signal supplied from the AC power supply shown in FIG. 1.
Figure 12:
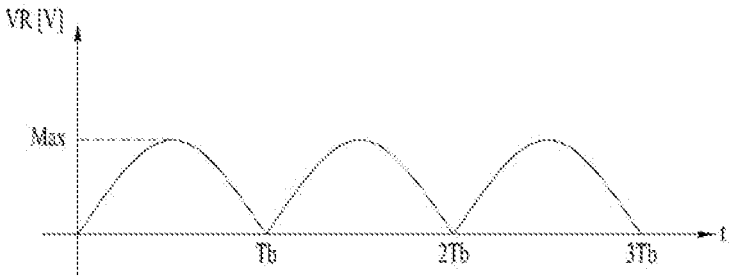
FIG. 12 is a diagram showing an embodiment of a rectified signal output from a rectifier as shown in FIG. 1.

FIG. 11 is a diagram showing the waveform of an exemplary AC signal $V_{ac}$ supplied from the AC power supply 110 shown in FIG. 1, and FIG. 12 is a diagram showing an embodiment of a rectified signal or voltage VR output from the exemplary rectifier 120 shown in FIG. 1.

Referring to FIGS. 11 and 12, although the AC signal $V_{ac}$ is a sine wave or cosine wave having a maximum value MAX, a minimum value MIN and a period Ta, embodiments of the invention are not limited thereto.

Furthermore, the AC signal $V_{ac}$ may be an AC voltage having a frequency of 50 Hz to 60 Hz. However, embodiments of the invention are not limited thereto.

The exemplary LED driving unit 105 may further include a fuse (not shown) connected between the AC power supply 110 and the rectifier 130. When an AC signal having an instantaneously high level is supplied, the fuse may be cut or severed to protect the LED driving unit 105 from the AC signal having a level higher than that tolerated by devices in the LED driving unit 105.

The rectifier 120 rectifies the AC signal $V_{ac}$ supplied from the AC power supply 110 and outputs a rectified signal (e.g., a ripple current or voltage) VR.

Although the rectifier 120 is implemented as a bridge diode circuit including four diodes BD1, BD2, BD3 and BD4 connected in a bridge structure, embodiments of the invention are not limited thereto.

The rectifier 120 may comprise a full-wave rectifier that rectifies the AC signal $V_{ac}$ and outputs a full-wave rectified AC signal VR (e.g., as shown in FIG. 12). The output of the rectifier 120 is referred to as a rectified signal or voltage.

The rectified signal or voltage VR output from the rectifier 120 may be supplied to the controller 130 and the light emitting unit 101. For example, the rectified signal or voltage VR may be supplied to an internal terminal of a first driving unit 130-1 and an input terminal of a first LED array D1.

Although the rectified signal or voltage VR has a waveform that is represented by the absolute value of a sine wave or a cosine wave, having a maximum value MAX, a minimum value of 0, and a period Tb, embodiments of the invention are not limited thereto. The period Tb of the rectified signal or voltage VR may be ½ the period Ta of the AC signal $V_{ac}$.

The controller 130 controls on and off states of each of the LED arrays (e.g., D1 to D4) of the exemplary light emitting unit 101, based on the rectified signal or voltage VR supplied from the rectifier 130.

The channel lines CH1 to CH4 may be connected between the LED arrays D1 to D4 and the controller 130.

The controller 130 may form a parallel current path with one or more of the LED arrays D1 to D3, and forms a current path with the LED array D4. In one embodiment, depending on the voltage on the channel line (e.g., CH1 to CH3), the corresponding driving unit 130-1 to 130-3 forms the parallel current path.

The controller 130 may include a plurality of driving units 130-1 to 130-3, respectively corresponding to the LED arrays D1 to D3. One LED array (e.g., D4) of the plurality of LED arrays does not have a corresponding driving unit.

For example, the light emitting unit 101 may include first to k-th LED arrays (e.g., k=4) and the controller 130 may include first to (k−1)-th driving units (e.g., k=4) respectively corresponding to first to (k−1)-th LED arrays (e.g., k=4).

For example, each of the first to (k−1)-th driving units (e.g., 130-1 to 130-3) may correspond to any one of the LED arrays D1 to D3 other than an LED array having an output terminal connected to a power supply (hereinafter, referred to as a "last LED array"). For example, although the power supply connected to an output terminal of the LED array D4 in FIG. 1 is a ground voltage Vss, embodiments of the invention are not limited thereto.

Furthermore, although k=4 in the exemplary light emitting unit 101, embodiments of the invention are not limited thereto. For example, k may be any integer of 2 or more.

The driving units 130-1 to 130-3 include input terminals (e.g., $A_1$, $A_2$ and $A_3$), output terminals (e.g., $K_1$, $K_2$ and $K_3$) and sensing terminals $S_1$, $S_2$ and $S_3$, respectively.

The exemplary driving units 130-1 to 130-3 are connected in series, and the output terminal of one driving unit (e.g., 130-1) may be connected to an input terminal of the next driving unit in series (e.g., 130-2). Also, the output terminal of a last driving unit in a series (e.g., 130-3) may be connected to a positive terminal ((+) terminal) of the last LED array in the corresponding series (e.g., D4).

The input terminal $A_1$, $A_2$ or $A_3$ of each driving unit 130-1, 130-2 or 130-3 may be connected to the positive terminal of the LED array corresponding thereto.

The sensing terminal $S_1$, $S_2$ or $S_3$ of each driving unit 130-1, 130-2 or 130-3 may be connected to the negative terminal of the LED array corresponding thereto.

The output terminal of the k-th (k being a natural number greater than 1) driving unit may be connected to the input terminal of the (k+1)-th driving unit, and the output terminal (e.g., $K_3$) of the last driving unit (e.g., 130-3) may be connected to the positive terminal of the last LED array (e.g., D4).

The rectified signal or voltage VR may be supplied to the input terminal of the first driving unit 130-1 and/or to the positive terminal of the first LED array D1.

If the voltage $V_{AS}$ across an LED array is less than a first reference voltage $V_{REF}$, each of the driving units 130-1 to 130-3 may form a first current path between the respective input terminal $A_1$, $A_2$ or $A_3$ and the respective output terminal $K_1$, $K_2$ or $K_3$.

In contrast, if the voltage $V_{AS}$ across the LED array D1, D2 or D3 is greater than the first reference voltage $V_{REF}$, each of the driving units 130-1 to 130-3 may form a second current path. For example, the second current path may include the LED array D1, D2 or D3, and at least one of the respective sensing terminal $S_1$, $S_2$ or $S_3$ and the respective output terminal $K_1$, $K_2$ or $K_3$ of the driving unit 130-1, 130-2 or 130-3. Optionally, the second current path may further include the respective input terminal $A_1$, $A_2$ or $A_3$ before the LED array D1, D2 or D3.

Figure 2:
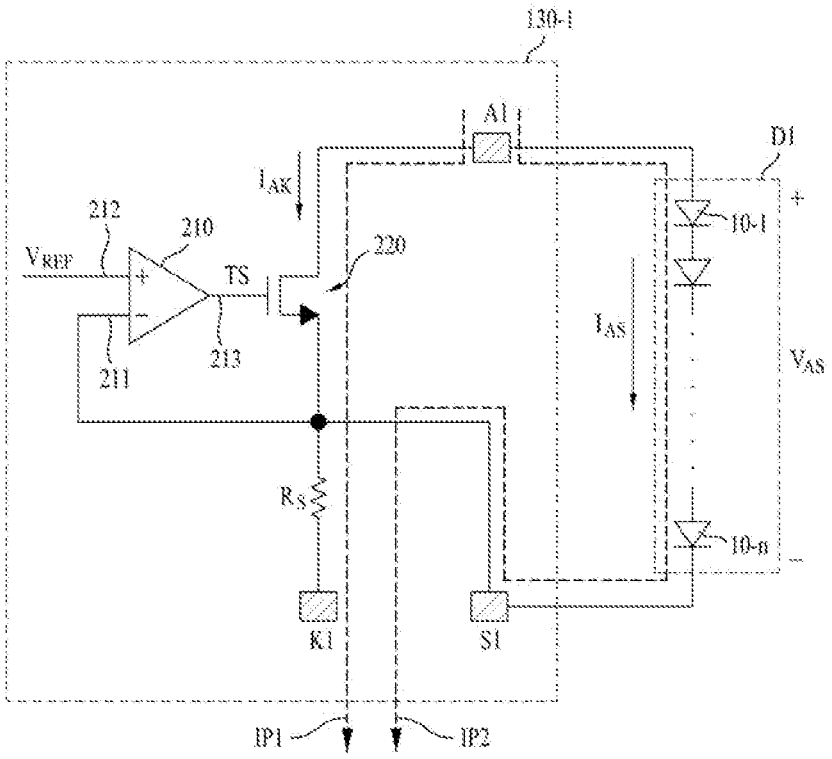
FIG. 2 is a diagram showing one or more embodiments of a first driving unit shown in FIG. 1.
Figure 3:
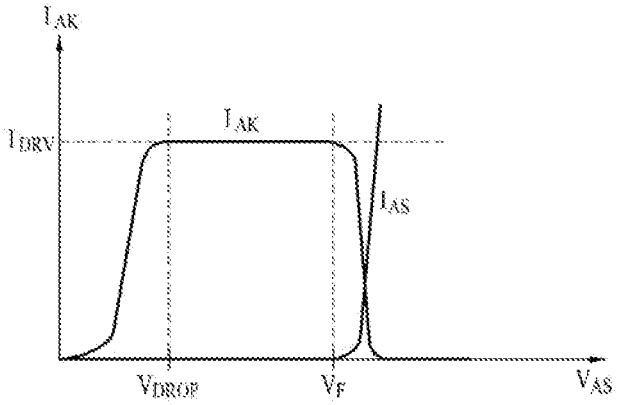
FIG. 3 is a graph showing the current between an input terminal and a sensing terminal of the first driving unit and the current flowing in a first LED array.

FIG. 2 is a diagram showing one or more embodiments of the first driving unit 130-1 shown in FIG. 1, and FIG. 3 is a graph showing the current $I_{AK}$ between the input terminal $A_1$ and the sensing terminal $S_1$ of the first driving unit 130-1 and a corresponding current $I_{AS}$ flowing in the first LED array D1. In FIG. 2, although only the first driving unit 130-1 will be described, the other driving units 130-2 and 130-3 operate identically or substantially identically to the first driving unit 130-1.

Referring to FIG. 2, the first driving unit 130-1 may include a first input terminal $A_1$, a first sensing terminal $S_1$, a first output terminal $K_1$, a first amplifier 210, a first transistor 220 and a first sensing resistor $R_s$.

The first input terminal $A_1$ may be connected to the positive terminal of the LED array D1, and the first sensing terminal $S_1$ may be connected to the negative terminal of the LED array D1. Alternatively, the first output terminal $K_1$ may be connected to the negative terminal of the LED array D1 (e.g., in embodiments that do not include a sensing resistor).

The positive terminal of the LED array D1 may be the positive terminal ((+) terminal) of the first LED 10-1 among the plurality of LEDs 10-1 to **10-*n* connected in series, and the negative terminal of the LED array D1 may be the negative terminal ((−) terminal) of the last LED 10-*n* among the plurality of LEDs 10-1 to 10-*n*** connected in series. Generally, n is an integer of 2 or more (e.g., 3, 4, 6, etc.).

The first amplifier 210 receives the voltage on the sensing terminal $S_1$ and a reference voltage $V_{REF}$, and outputs an amplified (or difference) signal TS.

For example, the first amplifier 210 may include a first input terminal 211 connected to the first sensing terminal $S_1$, a second input terminal 212 connected to the reference voltage $V_{REF}$, and an output terminal 213 that provides the amplified or difference signal TS.

For example, the first amplifier 210 may be a differential amplifier, that differentially amplifies (or determines a difference between) signals input to the first and second input terminals and outputs the amplified (or difference) signal TS.

The first transistor 220 may include a gate that receives the amplified (or difference) signal TS, and source and drain terminals connected between the input terminal $A_1$ and the sensing terminal $S_1$.

For example, the first transistor 220 may include a gate for receiving the amplified (or difference) signal TS, a drain connected to the input terminal $A_1$ and a source connected to the sensing terminal $S_1$.

The sensing resistor $R_s$ may be connected between the sensing terminal $S_1$ and the output terminal $K_1$.

The first transistor 220 may be turned on or off based on the voltage difference between the reference voltage $V_{REF}$ and voltage on the first sensing terminal $S_1$. Alternatively, the first transistor 220 may be turned on or off based on the voltage across the sensing resistor $R_s$.

If the voltage $V_{AS}$ across the first LED array D1 is less than the operating voltage VF of the first LED array ($V_{AS}$<VF), the first driving unit 130-1 enables current to flow though the first current path IP1 and enables current $I_{AS}$ (hereinafter, referred to as "LED current") flowing through the second current path IP2 to become or to remain at or about 0. Accordingly, current $I_{AK}$ (hereinafter, referred to as "driving unit current") flowing through the first current path IP1 of the first driving unit 130-1 is not influenced under such conditions. Furthermore, the reference voltage $V_{REF}$ may be selected such that the first LED array D1 is on or off, as desired, under the applicable operating conditions.

Here, the first current path IP1 may be a path of current flowing through the input terminal $A_1$ of the driving unit 130-1, the transistor 220, the sensing resistor $R_s$ and the output terminal $K_1$, and the second current path IP2 may be a path of current flowing through the LED array D1, the sensing terminal $S_1$ and the output terminal $K_1$. Optionally, the second current path IP2 may include the input terminal $A_1$ of the driving unit 130-1 before the LED array D1.

If the voltage $V_{AS}$ across the first LED array D1 is less than the operating voltage VF of the first LED array D1 ($V_{AS}$<VF), the transistor 220 of the first driving unit 130-1 is turned on, and the first driving unit 130-1 may function as a constant current source. At this time, the driving unit current $I_{AK}$ may be a constant current value $I_{DRV}=V_s/R_s$, and the constant current value $I_{DRV}$ may be obtained by dividing the voltage $V_s$ on the sensing terminal S1 by the sensing resistor $R_s$. In addition, the maximum value of the driving unit current $I_{AK}$ may be restricted to the constant current value $I_{DRV}$.

In contrast, if the voltage $V_{AS}$ across the first LED array D1 is equal to or greater than the operating voltage VF of the first LED array ($V_{AS}$≥VF), the first driving unit 130-1 enables the LED current $I_{AS}$ to flow through the second current path IP2.

If the voltage $V_{AS}$ across the first LED array D1 is equal to or greater than the operating voltage VF of the first LED array ($V_{AS}$≥VF, or alternatively, $V_{REF}$≤$V_S$), the transistor 220 is turned off. As the voltage $V_{AS}$ across the first LED array D1 increases beyond the operating voltage VF, the LED current $I_{AS}$ may increase, and the driving unit current $I_{AK}$ decreases proportionately and may finally become 0 [A]. The level of the LED current $I_{AS}$, the maximum value of the driving unit current $I_{AK}$, and/or the voltage $V_{AS}$ across the first LED array D1 may be changed by adjusting the sensing resistor $R_s$.

Figure 4A:
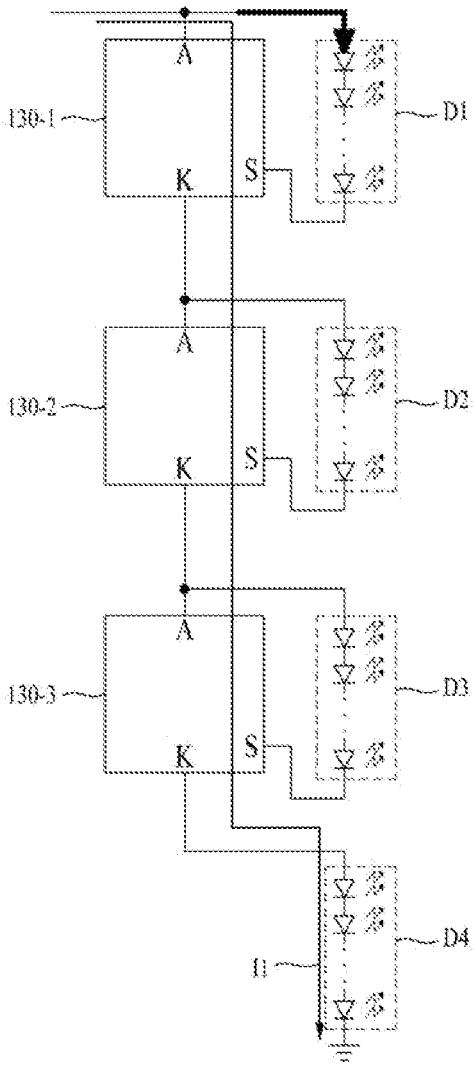
FIGS. 4A to 4D are diagrams showing exemplary driving units and on/off operations of an exemplary light emitting unit according to the level of the rectified signal (e.g., voltage)
Figure 4B:
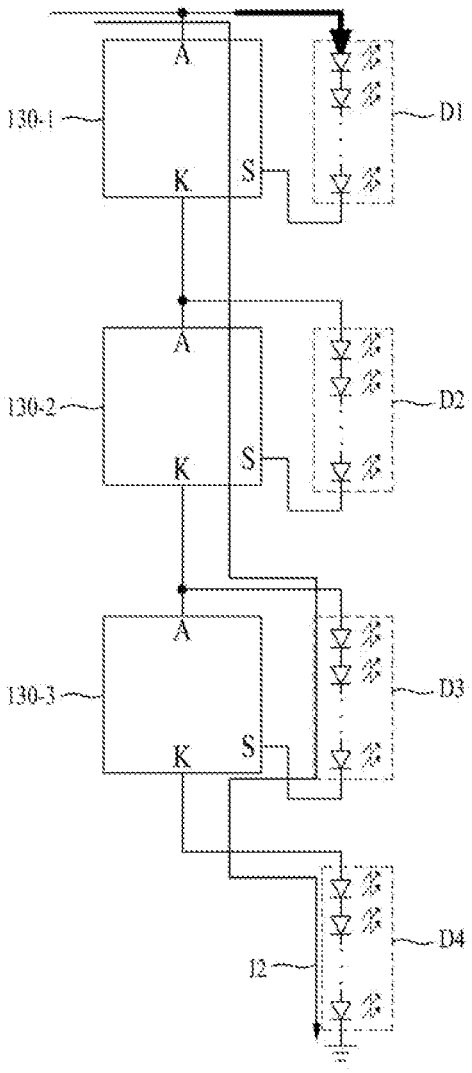
Figure 4C:
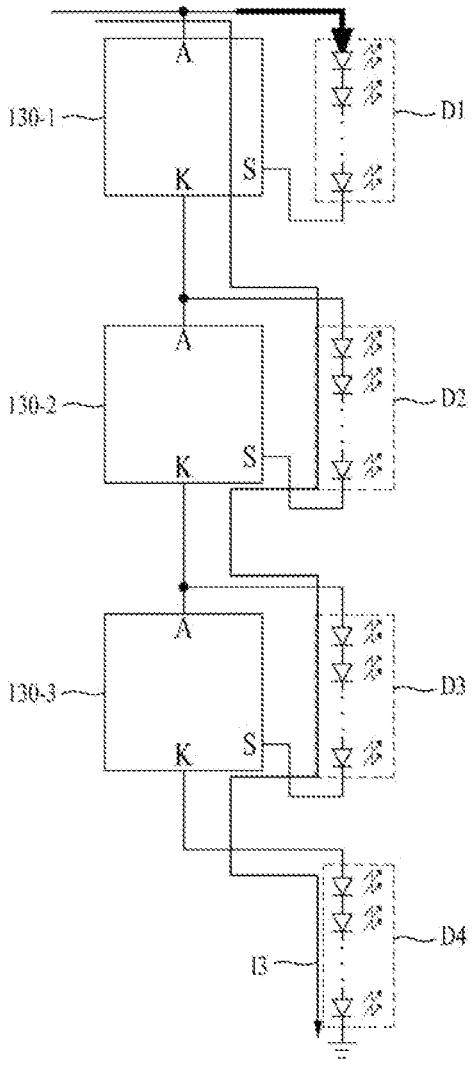
Figure 4D:
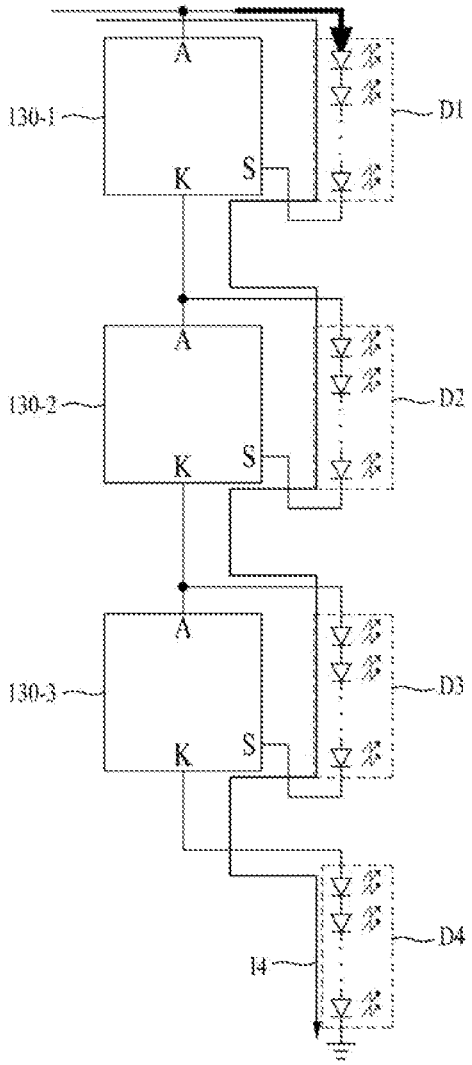
Figure 5:
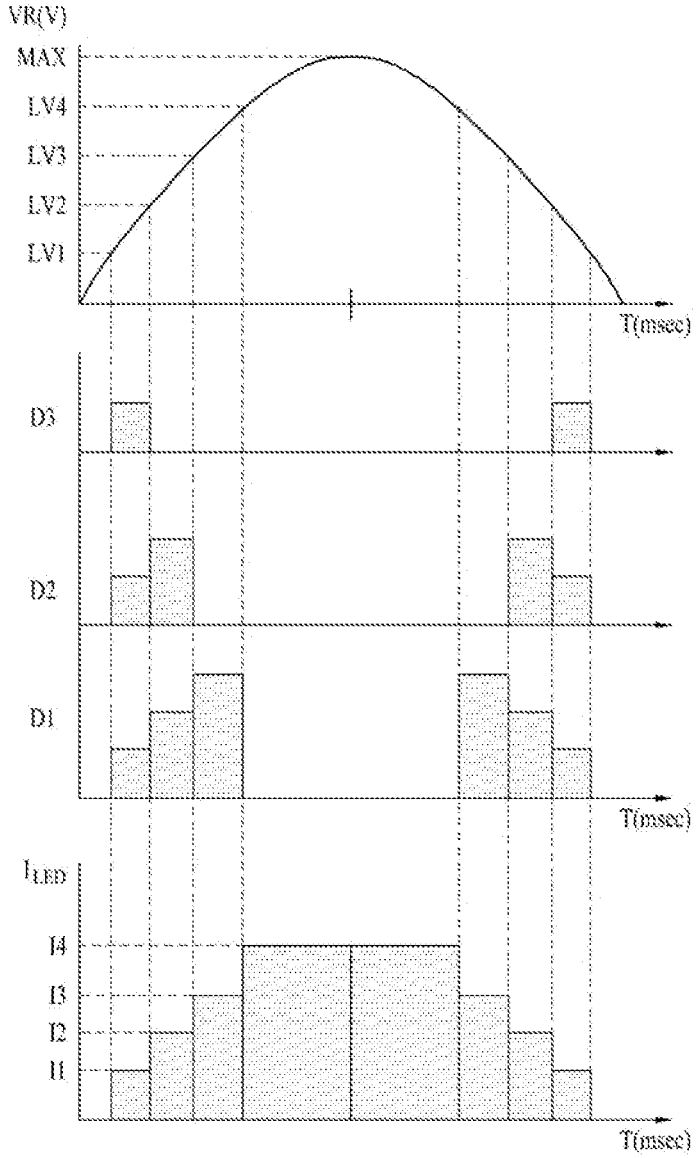
FIG. 5 is a graph showing exemplary operations of driving units and of current flowing in the LED arrays according to the rectified voltage level.

FIGS. 4A to 4D are diagrams showing exemplary operations of the driving units 130-1 to 130-3 turning the LED arrays D1-D3 in the light emitting unit 101 on or off according to the level of the rectified signal or voltage VR, and FIG. 5 is a graph showing exemplary operations of the driving units 130-1 to 130-3 and of currents I1 to I4 flowing in the LED arrays D1 to D4 according to the level of the rectified signal or voltage VR.

Referring to FIG. 4A, if the rectified signal or voltage VR is equal to or greater than a first level LV1 and is less than a second level LV2 (LV1≤VR<LV2), the reference voltage VF may be supplied across the fourth LED array D4, but the voltage $V_{AS}$ across each of the remaining LED arrays D1 to D3 may be less than the first reference voltage VF. Although the first reference voltage VF is the operating voltage of each LED array, embodiments of the invention are not limited thereto. Although the operating voltages of the LED arrays D1 to D4 may be identical, embodiments of the invention are not limited thereto.

Accordingly, each of the first to third driving units 130-1 to 130-3 may form the first current path. Current may not flow in the first to third LED arrays D1 to D3, and first current I1 may flow through the first current path of the first to third driving units 130-1 to 130-3 and the fourth LED array D4.

Although the first level LV1 may be equal to the voltage for operating one LED array (e.g., D4), embodiments of the invention are not limited thereto.

Referring to FIG. 4B, if the rectified signal or voltage VR is equal to or greater than the second level LV2 and is less than a third level LV3 (LV2≤VR<LV3), the first reference voltage VF may be supplied across the third and fourth LED arrays D3 and D4, but the voltage $V_{AS}$ across each of the remaining LED arrays D1 and D2 may be less than the first reference voltage VF.

Accordingly, each of the first and second driving units 130-1 and 130-2 may form the first current path, and the third driving unit 130-3 may form the second current path.

Current may not flow in the first and second LED arrays D1 and D2, and a second current I2 may flow through the first current path of each of the first and second driving units 130-1 and 130-2, the second current path of the third driving unit 130-3, and the fourth LED array D4.

Here, although the second level LV2 is equal to the voltage for operating two LED arrays (e.g., D3 and D4), embodiments of the invention are not limited thereto.

Referring to FIG. 4C, if the rectified signal or voltage VR is equal to or greater than the third level LV3 and is less than a fourth level LV4 (LV3≤VR<LV4), the first reference voltage VF may be supplied across each of the second to fourth LED arrays D2 to D4, but the voltage $V_{AS}$ across the first LED array D1 may be less than the first reference voltage VF.

Accordingly, the first driving unit 130-1 may form the first current path, and each of the second and third driving unit 130-2 and 130-3 may form the second current path.

Current may not flow in the first LED array D1, and a third current I3 may flow through the first current path of the first driving unit 130-1, the second current path of each of the second and third driving units 130-2 and 130-3, and the fourth LED array D4.

Here, although the third level LV3 is equal to the voltage for operating three LED arrays (e.g., D2 to D4), embodiments of the invention are not limited thereto.

Referring to FIG. 4D, if the rectified signal or voltage VR is equal to or greater than the fourth level LV4 (LV4≤VR), the first reference voltage VF may be supplied across each of the first to fourth LED arrays D1 to D4.

Accordingly, each of the first to third driving units 130-1 to 130-3 may form the second current path. Fourth current I4 may flow through the second current path of each of the first to third driving units 130-1 to 130-3 and the fourth LED array D4.

Here, although the fourth level LV4 is equal to the voltage for operating four LED arrays (e.g., D1 to D4), embodiments of the invention are not limited thereto.

If the rectified signal or voltage VR is less than the first level LV1 (VR<LV1), since the voltage across each of the first to fourth LED arrays D1 to D4 is less than the reference voltage VF, the first to fourth LED arrays D1 to D4 may be turned off.

Figure 6:
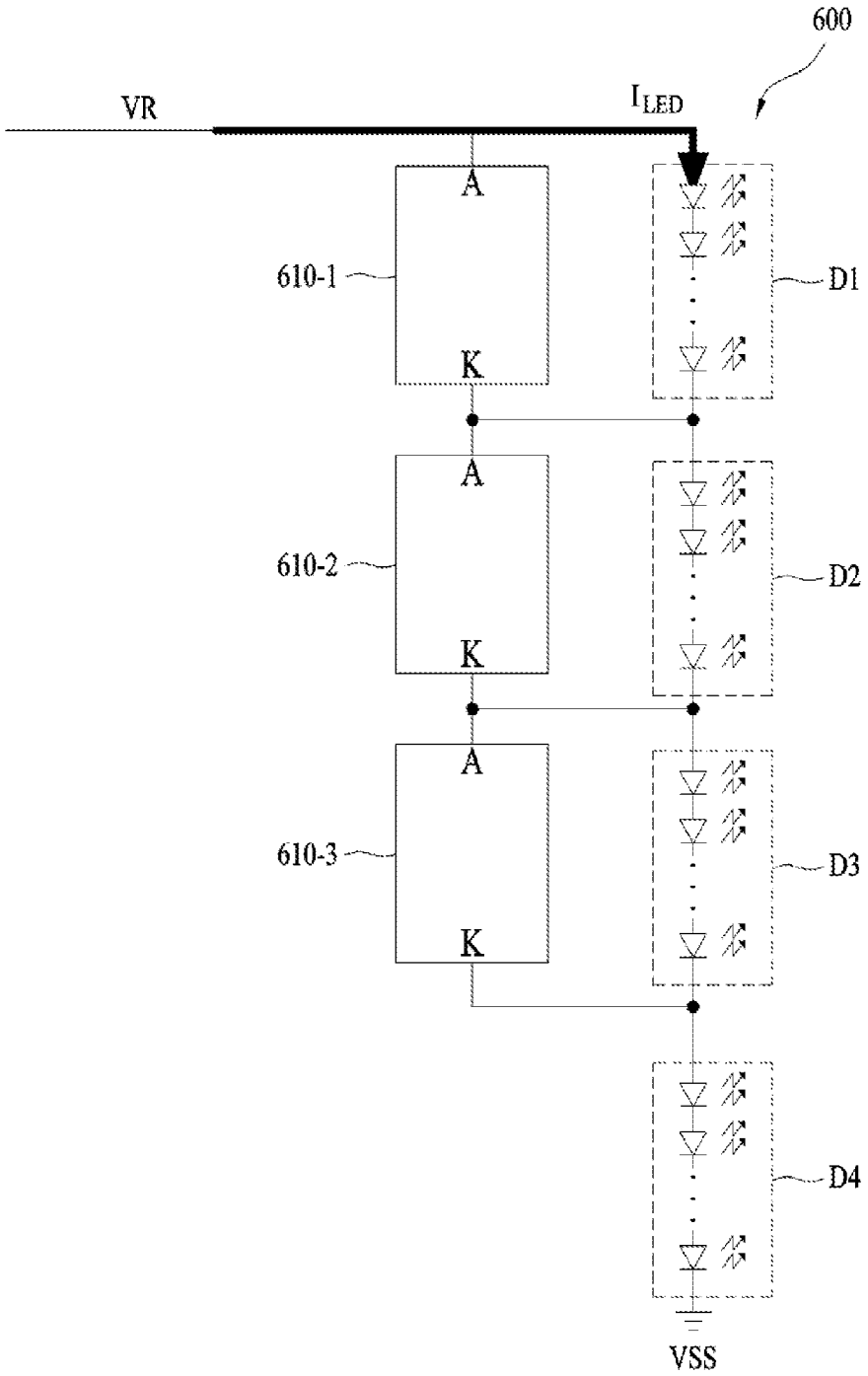
FIG. 6 is a diagram showing driving units and LED arrays according to a comparative example.
Figure 7:
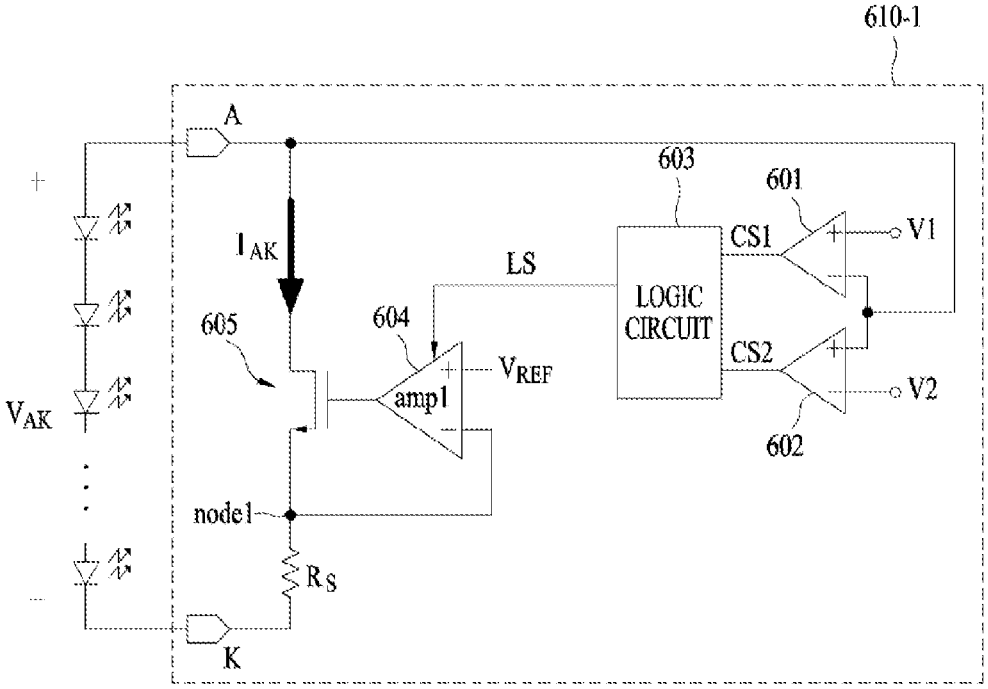
FIG. 7 is a diagram showing the configuration of the driving unit shown in FIG. 6.
Figure 8:
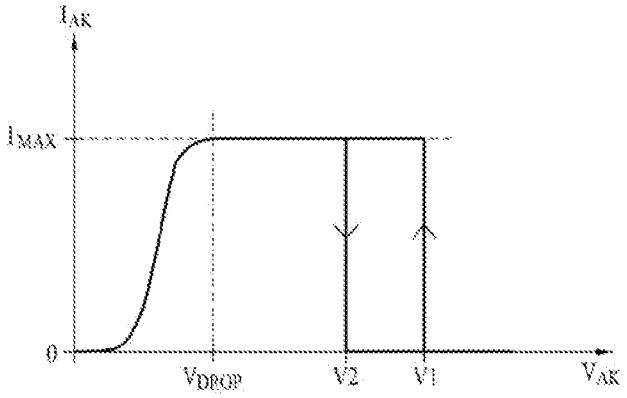
FIG. 8 is a graph showing a relationship between the current between input and output terminals of the driving unit shown in FIG. 7 and the voltage across the LED array shown in FIG. 7.

FIG. 6 is a diagram showing driving units 610-1 to 610-3 and LED arrays D1 to D4 according to a comparative example 600, FIG. 7 is a diagram showing the configuration of the driving unit (e.g., 610) shown in FIG. 6, and FIG. 8 is a graph showing the relationship between the current $I_{AK}$ (between the input terminal A and the output terminal K of the driving unit 610-1 shown in FIG. 7) and the voltage across the LED array shown in FIG. 7.

Referring to FIGS. 6 to 8, each of the driving units 610-1 to 610-3 detects the voltage $V_{AK}$ across each of the LED arrays D1, D2 and D3 and cuts off the current path between the input terminal A and the output terminal K of each of the driving units 610-1 to 610-3 if the detected voltage $V_{AK}$ across each of the LED arrays D1, D2 and D3 is equal to or greater than the first reference voltage VF.

In contrast, each of the driving units 610-1 to 610-3 forms a current path between the input terminal A and the output terminal K if the detected voltage $V_{AK}$ across each of the LED arrays D1, D2 and D3 is less than the first reference voltage VF.

The driving units 610-1 to 610-3 may sequentially drive the first to fourth LED arrays D1 to D4 as the voltage of the rectified signal or voltage VR changes.

The configuration of each of the driving units 610-1 to 610-3 will now be described.

FIG. 7 shows only the configuration of the first driving unit 610-1. The configurations of the driving units 610-1 to 610-3 are substantially identical.

The first driving unit 610-1 may include an input terminal A, an output terminal K, a first comparator 601, a second comparator 602, a logic circuit 603, an amplifier 604, a transistor 605 and a sensing resistor Rs.

The first comparator 601 compares the voltage $V_{AK}$ across the LED array D1 (or D2 or D3, in further embodiments) and a first voltage V1, and outputs a first comparison signal CS1.

The second comparator 602 compares the voltage $V_{AK}$ across the LED array D1 (or D2 or D3, in further embodiments) and a second voltage V2, and outputs a second comparison signal CS2.

The logic circuit 603 performs a logic operation on the first comparison signal CS1 and the second comparison signal CS2, and outputs a logic signal LS according to the logic operation.

The amplifier 604 is enabled or disabled in response to the logic signal LS, and includes a first input terminal connected to a node node1 between the first transistor 604 and the sensing resistor, a second input terminal connected to a reference voltage VREF, and an output terminal that provides an amplified (or difference) signal TS1.

The transistor 605 includes a gate for receiving the amplified (or difference) signal TS1, a drain connected to the input terminal A of the first driving unit 610-1, and a source connected to the sensing resistor Rs.

The sensing resistor Rs is connected between the source of the transistor 605 and the output terminal K. The node between the sensing resistor Rs and the source of the transistor 605 is connected to the first input terminal of the amplifier 604.

If the voltage $V_{AK}$ across the LED array D1 is greater than the first voltage V1, the amplifier 604 is disabled by the logic signal LS generated by the logic circuit 603. If the amplifier 604 is disabled, the transistor 605 is turned off.

In contrast, if the voltage $V_{AK}$ across the LED array D1 is less than the second voltage V2, the amplifier 604 is enabled by the logic signal LS generated by the logic circuit 603. If the amplifier is enabled, the amplifier 604 forms a negative feedback path with the transistor 605 and the sensing resistor Rs, and functions as a constant current source. At this time, current $I_{AK}$ flowing from the input terminal A of the driving unit 610-1 to the sensing terminal S is equal to $V_{REF}$/Rs.

The driving unit 610-1 shown in FIG. 7 may control current flowing between the input terminal A and the output terminal K of the driving unit 610-1 according to the phase or level of the rectified signal or voltage VR. In the comparative example 600, the level of the rectified signal or voltage VR causes the driving units 610-1 to sequentially turn the LED arrays D1 to D4 on and off.

Figure 9:
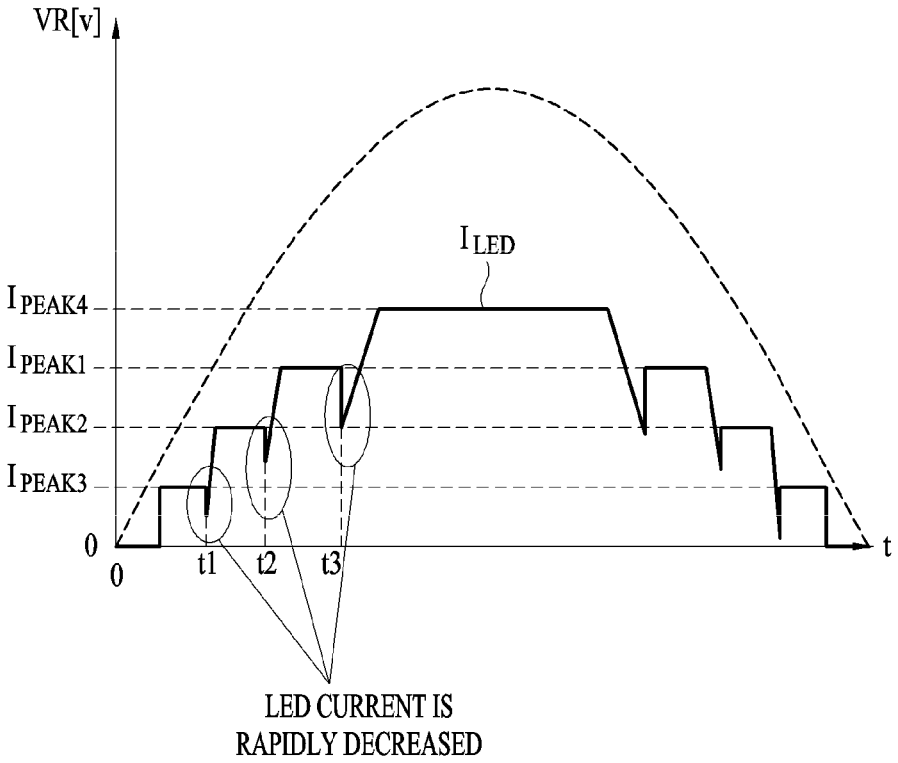
FIG. 9 is a diagram showing the current flowing in the LED arrays shown in FIG. 6 according to the rectified voltage level.

FIG. 9 is a diagram showing the current $I_{LED}$ flowing in the LED arrays D1 to D4 shown in FIG. 6 according to the level of the rectified signal or voltage VR.

Referring to FIG. 9, when the transistor 605 of the driving units 610-1, 610-2 and 610-3 is turned on or off, the current I_LED flowing in the LED arrays D1 to D4 instantaneously rapidly decreases (e.g., at times t1, t2 and t3, before the current flows through the LED arrays D3, D2 and D1 connected to the respective driving units 610-3, 610-2 and 610-1).

This is because the current I_LEDn+1 flowing in the (n+1)-th LED array Dn+1 is restricted by a lack of current I_LEDn flowing in the n-th LED array Dn.

That is, I_LEDn+1 is equal to I_LEDn+I_Dn after the driving unit **610-*n* is turned on and before the driving unit 610-*n* is turned off, but the current I_Dn is 0 when the driving unit 610-*n* is turned on or off. Thus, I_LEDn+1 becomes I_LEDn immediately after the driving unit 610-*n*** is turned on or off. Accordingly, the current I_LEDn+1 in the (n+1)-th LED array Dn+1 rapidly decreases immediately after a driving unit is turned on or off.

Figure 10:
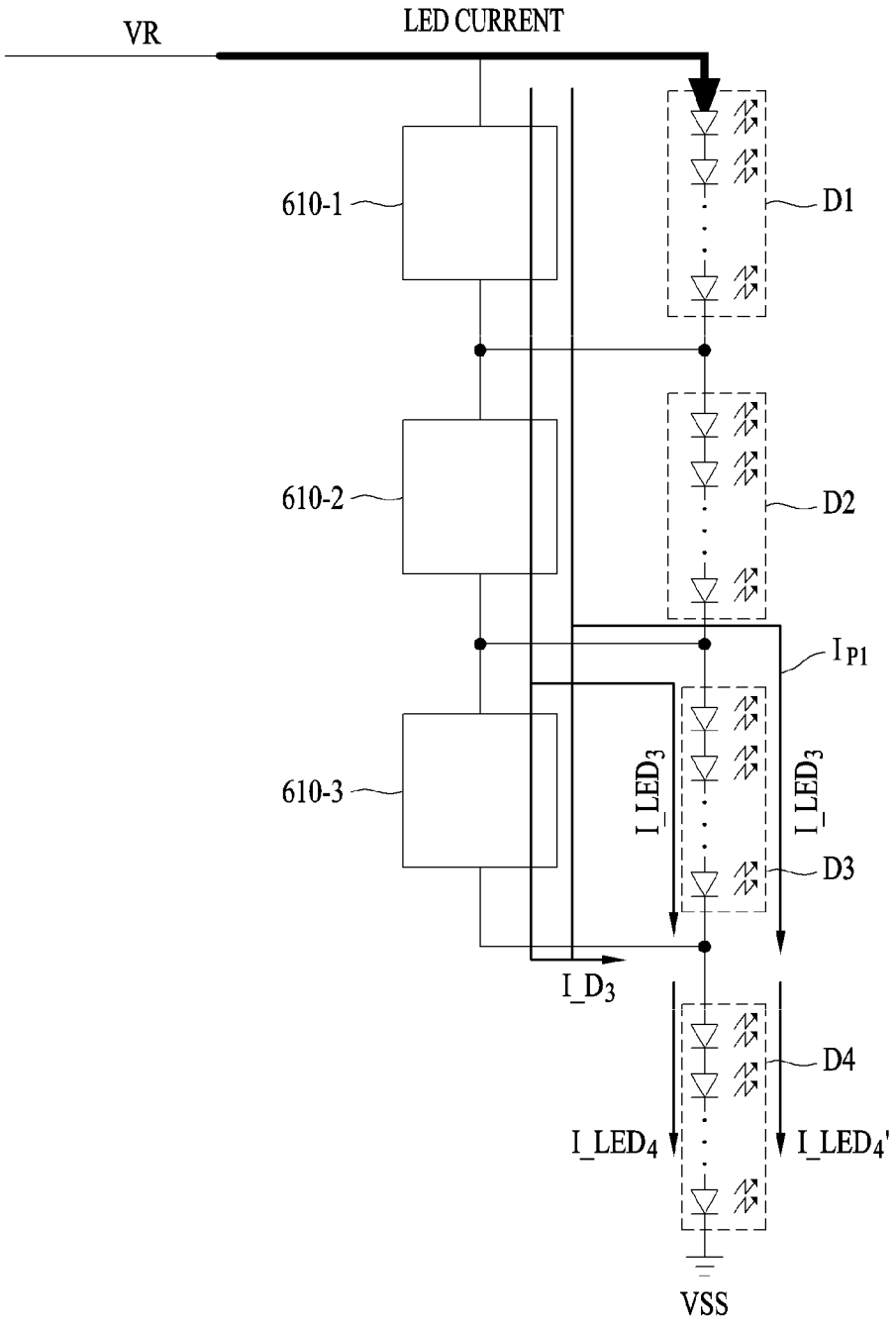
FIG. 10 is a diagram showing the change in the current path and the change in the amount of current when a third driving unit of FIG. 6 is turned off.

FIG. 10 is a diagram showing the change in current path and the change in the amount of current when the third driving unit 610-3 of FIG. 6 is turned off.

Referring to FIG. 10, the first to third driving units 610-1 to 610-3 are in the on state, and a current I_LED4 flowing in the LED array D4 just before the third driving unit 610-3 is turned off may be I_LED3+I_D3. The current I_LED4' flowing in the LED array D4 after the third driving unit 610-3 is turned off may be I_LED3.

Accordingly, as compared to the current I_LED4 in the LED array D4 just before the third driving unit 610-3 is turned off, the current I_LED4' in the LED array D4 just after the third driving unit 610-3 is turned off may instantaneously rapidly decrease. Such a result may cause harmonic distortion (e.g., total harmonic distortion, or THD) and electromagnetic interference (EMI).

However, in embodiments of the present invention, current flowing in the LED arrays D1 to D4 when the driving units 130-1, 130-2 and 130-3 are turned on or off does not rapidly decrease.

Referring to FIG. 3, as the driving unit current $I_{AK}$ decreases, the LED current $I_{AS}$ increases, and vice versa. Therefore, the driving unit current $I_{AK}$ does not rapidly decrease when the driving units (e.g., 130-1) are turned on or off, but rather, decreases in accordance with the reduction in the LED current $I_{AS}$.

A comparison with FIG. 10 will now be given.

When the first to third driving units 130-1 to 130-3 are in the on state, the current I_LED4 in the LED array D4 just before the third driving unit 130-3 is turned off is I_LED3+I_D3. Here, I_LED3 is the current flowing in the LED array D3 just before the third driving unit 130-3 is turned off, and I_D3 is current flowing in the third driving unit 130-3 just before the third driving unit 130-3 is turned off.

Since the transistor 220 of a driving unit **130-*n* in the present LED driving unit gradually turns off when the driving unit (e.g., 130-*n*) is turned off, the current I_LED' in the (n+1)-th LED array Dn does not rapidly decrease after the n-th driving unit 130-*n*** is turned off. Therefore, according to embodiments of the invention, it is possible to suppress the phenomenon in which current flowing in the LED array rapidly decreases when a driving unit is turned on or off. This design effectively suppresses harmonic distortion (e.g., THD) and EMI.

If the driving unit 610-1 shown in FIG. 7 is used, the operating voltage VF of the LED array may not be freely selected when designing or manufacturing the LED system.

That is, an LED array having an operating voltage (V2<VF<V1) between predetermined first and second voltages V1 and V2 of the driving unit 610-1 should be used.

If the operating voltage VF of the LED array is not a voltage between the first voltage V1 and the second voltage V2, the LED system may not operate normally.

For example, if the operating voltage VF of the LED array is 50V, the first voltage V1 is 52V, and the second voltage V2 is 48V, when the voltage VAK across the LED array is equal to or greater than the operating voltage VF, the driving units may be turned off, and the LED system may operate normally.

However, if the operating voltage VF of the LED array is 50V, the first voltage V1 is 47V, and the second voltage V2 is 43V, even when the voltage VAK across the LED array is less than the operating voltage VF, one or more of the driving units may be turned off, and thus the LED system may not operate normally.

In embodiments of the invention, the operating voltage of the LED array can be freely selected when designing or manufacturing the LED system. As shown in FIG. 2, the driving unit 130-1 can operate without being restricted by the first and second voltages V1 and V2 of FIG. 7, regardless of the operating voltage of the LED array.

Features, structures, effects, and the like as described above in the embodiments are included in at least one embodiment of the present invention and should not be limited to only one embodiment. In addition, the features, structures, effects, and the like described in the respective embodiments may be combined or modified even with respect to the other embodiments by those skilled in the art. Accordingly, contents related to these combinations and modifications should be construed as within the scope of the present invention.

What is claimed is:

1. An apparatus for driving and/or controlling a light emitting unit including first to k-th arrays of light emitting diodes (LEDs), the apparatus comprising:

a rectifier configured to rectify an alternating current (AC) signal and supply a rectified signal or voltage to the light emitting unit; and first to (k−1)-th driving units respectively corresponding to the first to (k−1)-th LED arrays, wherein k is an integer of at least 2, and each of the first to (k−1)-th driving units includes:

an input terminal connected to a positive terminal of the corresponding LED array;

a sensing terminal connected to a negative terminal of the corresponding LED array;

an output terminal connected to an input terminal of a next driving unit and/or LED array;

a transistor connected between the input terminal and the sensing terminal; and a sensing resistor connected between the sensing terminal and the output terminal, and wherein the rectified signal or voltage is applied to the input terminal of the first driving unit.

2. The apparatus according to claim 1, wherein the output terminal of the (k−1)-th driving unit is connected to a positive terminal of the k-th LED array.

3. The apparatus according to claim 1, wherein k is at least 4.

4. The apparatus according to claim 1, wherein the transistor is on or off based on a voltage on the sensing terminal.

5. The apparatus according to claim 1, further comprising an amplifier including:

a first input terminal connected to the sensing terminal;

a second input terminal configured to receive a reference voltage; and an output terminal connected to a gate of the transistor.

6. The apparatus according to claim 1, wherein the transistor is turned off when a voltage across the corresponding LED array is equal to or greater than an operating voltage of the LED array.

7. The apparatus according to claim 6, wherein the transistor is turned on when a voltage across the LED array is less than an operating voltage of the LED array.

8. The apparatus according to claim 1, wherein the rectifier comprises a full-bridge rectifier.

9. A light emitting diode (LED) system comprising:

a light emitting unit including first to k-th LED arrays; and the apparatus according to claim 1.

10. The LED system according to claim 9, wherein each of the LED arrays comprises a plurality of LEDs connected in series.

11. The LED system according to claim 10, wherein each of the plurality of LEDs connected in series comprises at least 4 LEDs.

12. An apparatus for driving and/or controlling a light emitting unit including first to k-th arrays of light emitting diodes (LEDs), the apparatus comprising:

a rectifier configured to rectify an alternating current (AC) signal and supply a rectified signal or voltage to the light emitting unit; and a plurality of driving units respectively corresponding to the LED arrays other than the k-th LED array and connected in series, wherein each of the plurality of driving units includes:

an input terminal and a sensing terminal connected to a unique one of the LED arrays, other than the k-th LED array; and an output terminal connected to an input terminal of a next driving unit, the input terminal of the first driving unit of the plurality of driving units receives the rectified signal or voltage, and the output terminal of the last driving unit of the plurality of driving units is connected to a positive terminal of the k-th LED array, and each of the plurality of driving units forms (a) a first current path between the input terminal and the output terminal or (b) a second current path comprising the LED array and at least one of the sensing terminal and the output terminal, according to a voltage level across the LED array and/or a reference voltage.

13. The apparatus according to claim 12, wherein each of the driving units further includes a transistor including a gate, a first source/drain terminal connected to the input terminal, and a second source/drain terminal connected to the sensing terminal.

14. The apparatus according to claim 13, wherein each of the driving units further includes a sensing resistor between the sensing terminal and the output terminal.

15. The apparatus according to claim 14, wherein each of the driving units further includes an amplifier including:

a first input terminal connected to a node between the sensing resistor and the sensing terminal;

a second input terminal configured to receive a reference voltage; and an output terminal connected to the gate of the transistor.

16. The apparatus according to claim 12, wherein k is at least 4.

17. The apparatus according to claim 12, wherein the rectifier comprises a full-bridge rectifier.

18. A light emitting diode (LED) system comprising:

a light emitting unit including first to k-th LED arrays; and the apparatus according to claim 12.

19. The LED system according to claim 18, wherein each of the LED arrays comprises a plurality of LEDs connected in series.

20. The LED system according to claim 19, wherein each of the plurality of LEDs connected in series comprises at least 4 LEDs.

* * * * *